US010228628B2

(12) United States Patent
Yamashita et al.

(10) Patent No.: US 10,228,628 B2
(45) Date of Patent: Mar. 12, 2019

(54) TONER AND METHOD FOR MANUFACTURING THE SAME

(71) Applicant: CANON KABUSHIKI KAISHA, Tokyo (JP)

(72) Inventors: Daisuke Yamashita, Tokyo (JP); Takaho Shibata, Tokyo (JP); Hayato Ida, Toride (JP); Junichi Tamura, Toride (JP); Akemi Watanabe, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/659,474

(22) Filed: Jul. 25, 2017

(65) Prior Publication Data

US 2018/0031991 A1 Feb. 1, 2018

(30) Foreign Application Priority Data

Jul. 28, 2016 (JP) ..... 2016-148016

(51) Int. Cl.

*G03G 9/087* (2006.01)
*G03G 9/09* (2006.01)
*G03G 9/08* (2006.01)

(52) U.S. Cl.

CPC ..... *G03G 9/08773* (2013.01); *G03G 9/0804* (2013.01); *G03G 9/0806* (2013.01); *G03G 9/0819* (2013.01); *G03G 9/0825* (2013.01); *G03G 9/08708* (2013.01); *G03G 9/08755* (2013.01); *G03G 9/08795* (2013.01); *G03G 9/08797* (2013.01); *G03G 9/0904* (2013.01)

(58) Field of Classification Search

CPC ..... G03G 9/08773; G03G 9/0904; G03G 9/08708; G03G 9/0819; G03G 9/0806; G03G 9/0825

See application file for complete search history.

(56) References Cited

U.S. PATENT DOCUMENTS 6,030,739 A * 2/2000 Ishikawa ..... G03G 9/08773 430/108.3
2006/0154167 A1* 7/2006 Lee ..... G03G 9/0804 430/109.3

FOREIGN PATENT DOCUMENTS

JP 2003-140380 A 5/2003
JP 2005-31159 A 2/2005
JP 2007-86211 A 4/2007
JP 2007-264333 A 10/2007

* cited by examiner

*Primary Examiner* — Thorl Chea
(74) *Attorney, Agent, or Firm* — Canon U.S.A. Inc., IP Division

(57) ABSTRACT

A toner in which the content of polysiloxane is 1% by mass or more and 15% by mass or less based on the total mass of toner particles, the polysiloxane is present in the toner as a domain of 10 nm or more and 500 nm or less, and Siloxane index (Ge)/Siloxane index (D) of the toner particles is 1.0 or less.

9 Claims, 3 Drawing Sheets

TONER AND METHOD FOR MANUFACTURING THE SAME

BACKGROUND OF THE INVENTION

Field of the Invention

The present disclosure relates to a toner for use in an electrophotographic image forming method and a method for manufacturing the toner.

Description of the Related Art

Heretofore, a means has been taken which blends wax in a toner in order to achieve both the paper separability of a toner and the durability of a toner. In recent years, in connection with an increase in a demand for an increase in speed, there has been a problem that the flow out of wax contained in a toner to the toner particle surface layer in fixing is insufficient, so that paper is wound around a fixing roller. Thus, Japanese Patent Laid-Open No. 2005-31159 has proposed a means of increasing the amount of wax contained in a toner or a means of controlling the amount of wax of a toner particle surface layer.

Moreover, in Japanese Patent Laid-Open Nos. 2003-140380, 2007-86211, and 2007-264333, an examination of blending polysiloxane in a toner has also been conducted as a means of improving paper separability.

It has been proposed to improve the paper separability by increasing the amount of wax contained in a toner. However, there has been a problem that, when the amount of a mold release agent contained in a toner is increased, the amount of wax of a toner particle surface layer also increases, which causes deterioration of flowability. Moreover, although it has also been proposed to prevent deterioration of flowability by blending wax in toner particles, it takes time for a solid wax to be melt in fixing to flow out to a toner particle surface layer, and therefore the solid wax has been difficult to cope with paper separation at a high speed.

Moreover, the paper separability is improved by blending polysiloxane, such as dimethylpolysiloxane, in a toner but there has been a problem that the polysiloxane is exposed to a toner particle surface layer during storage, which causes deterioration of the flowability of the toner.

SUMMARY OF THE INVENTION

The present disclosure provides a toner in which paper separability at a high speed is improved while holding the flowability of the toner and a method for manufacturing the same.

Then, the present inventors have conducted an examination, and, as a result, it has been clarified that polysiloxane is blended in toner particles, the presence amount of the polysiloxane in the toner particle surface layer is controlled, and further 10 to 500 nm holes are formed in the toner particles, whereby the polysiloxane enters the holes, so that the bleeding of the polysiloxane from the toner particles is prevented even during storage and coping with high speed separation can be achieved.

More specifically, the present disclosure relates to a toner having toner particles each of which contains a binding resin having an ester bond, a colorant, and polysiloxane, in which the toner particles contain the polysiloxane in a content of 1 mass % or more and 15 mass % or less based on a total mass of the toner particles, each of the toner particles has a domain in which the polysiloxane is contained, wherein in a cross section of each of the toner particles, a hole derived from the domain has a major axis of 10 nm or more and 500 nm or less, wherein when in an FT-IR spectrum of the toner particles measured and obtained by an ATR method under conditions where Ge is used as an ATR crystal and an infrared light incidence angle is 45°, a maximum absorption peak intensity in a range of 990 $cm^{-1}$ or more and 1040 $cm^{-1}$ or less derived from Si—O of the polysiloxane is defined as Pa (Ge), a maximum absorption peak intensity in a range of 1500 $cm^{-1}$ or more and 1800 $cm^{-1}$ or less derived from C(═O) of an ester group of the binding resin is defined as Pb (Ge), and a value of Pa (Ge)/Pb (Ge) is defined as a siloxane index (Ge); and in an FT-IR spectrum of the toner particles measured and obtained by an ATR method under conditions where diamond is used as an ATR crystal and an infrared light incidence angle is 45°, a maximum absorption peak intensity in a range of 990 $cm^{-1}$ or more and 1040 $cm^{-1}$ or less derived from the Si—O of the siloxane is defined as Pa (D), a maximum absorption peak intensity in a range of 1500 $cm^{-1}$ or more and 1800 $cm^{-1}$ or less derived from the C(═O) of the ester group of the binding resin is defined as Pb (D), and a value of Pa(D)/Pb(D) is defined as a siloxane index (D), a ratio of the siloxane index (Ge) to the siloxane index (D), i.e. Siloxane index (Ge)/Siloxane index (D), is 1.0 or less.

Further features of the present disclosure will become apparent from the following description of exemplary embodiments with reference to the attached drawings.

DESCRIPTION OF THE EMBODIMENTS

Figure 1:
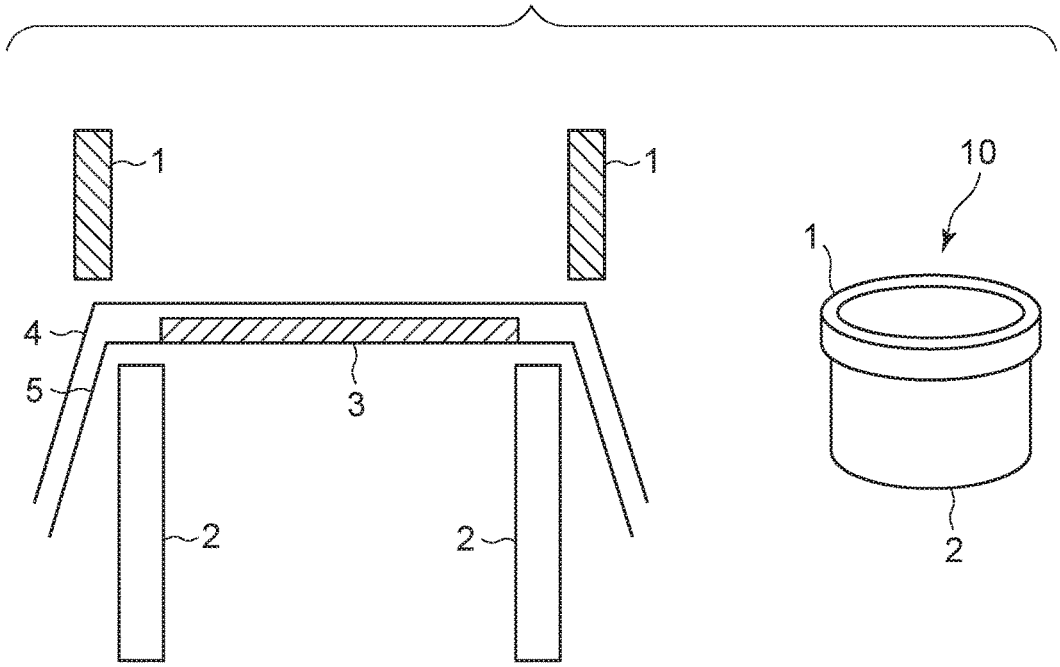
FIG. 1 is a schematic view illustrating a small amount sample measurement container for fluorescent X-ray measurement.

A toner of the present disclosure is a toner having toner particles each of which contains a binding resin, a colorant, and polysiloxane, in which the binding resin needs to have an ester bond.

From the viewpoint of an improvement of the strength of a toner, an ester bond in the binding resin is present. Known polymers usually used for a toner are usable insofar as it is a resin containing an ester group. Specifically, the Following Polymers are Usable.

Mentioned are styrene copolymers, such as polyvinyl acetate, polyester resin, a styrene-(meth)acrylic acid ester copolymer, and a styrene-α-chlormethyl methacrylate copolymer, and the like. The binding resin may be used alone or in combination of two or more kinds thereof. Among the polymers, even when the number of ester groups is large and the molecular weight is low, an amorphous polyester resin excellent in strength is suitable. As the amorphous polyester resin, those obtained by condensation polymerization of alcohol monomers and carboxylic acid monomers are used. Examples of the alcohol monomers include the following substances. Mentioned are alkylene oxide adducts of bisphenol A, such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane, ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, hydrogenated bisphenol A, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxy methylbenzene.

On the other hand, examples of the carboxylic acid monomers include the following substances. Mentioned are aromatic dicarboxylic acids, such as phthalic acid, isophthalic acid, and terephthalic acid, or anhydrides thereof; alkyl dicarboxylic acids, such as succinic acid, adipic acid, sebacic acid, and azelaic acid, or anhydrides thereof; succinic acids substituted by alkyl groups or alkenyl groups having 6 to 18 carbon atoms or anhydrides thereof; and unsaturated dicarboxylic acids, such as fumaric acid, maleic acid, and citraconic acid, or anhydrides thereof.

In addition thereto, the following monomers are usable.

Mentioned are polyhydric alcohols, such as glycerol, sorbitol, sorbitan, and further oxyalkylene ethers of novolak type phenol resin, for example; polycarboxylic acids, such as trimellitic acid, pyromellitic acid, benzophenone tetracarboxylic acid, and anhydrides thereof.

Among the above, a resin is suitable which is obtained by condensation polymerization of a bisphenol derivative represented by the following general formula (1) used as a divalent alcohol monomer component and a carboxylic component containing divalent or more carboxylic acids, acid anhydrides thereof, or lower alkyl esters thereof (for example, fumaric acid, maleic acid, maleic acid anhydride, phthalic acid, terephthalic acid, trimellitic acid, pyromellitic acid, and the like) used as an acid monomer component with polyester unit components thereof.

(1)

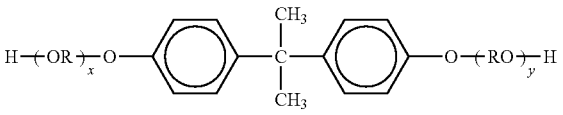

In General Formula 1, R represents an ethylene group or a propylene group, x and y each are integers of 1 or more, and the average value of x+y is 2 to 10.

When a siloxane bond is present in the binding resin, there is a possibility that the flow out of the polysiloxane is prevented and the releasability deteriorates. Therefore, it is suitable to contain no siloxane bond in the binding resin.

The binding resin suitably has ionic groups, such as a carboxylic acid group, a sulfonic acid group, and an amino group, in the resin frame and more suitably has a carboxylic acid group. The acid value of the binding resin is suitably 3 mgKOH/g or more and 35 mgKOH/g or less and more suitably 8 mgKOH/g or more and 25 mgKOH/g or less. When the acid value of the binding resin is in the ranges mentioned above, good charge amount is obtained either in a high humidity environment or in a low humidity environment. The acid value refers to the number in terms of mg of potassium hydroxide required for neutralizing free fatty acid and resin acid contained in 1 g of a specimen. As a measuring method, the acid value is measured according to JIS-K0070.

The polysiloxane is not particularly limited. For example, dimethyl polysiloxane, methylphenyl polysiloxane, α-methylstyrene-modified polysiloxane, alkyl-modified polysiloxane, chlorphenyl polysiloxane, fluorine-modified polysiloxane, and the like are usable. The kinetic viscosity of the polysiloxane is suitably 50 cSt or more and 1000 cSt or less at 25° C. When the kinetic viscosity is lower than 50 cSt, the polysiloxane may evaporate in fixing of the toner. When the kinetic viscosity is higher than 1000 cSt, the toner paper separability may deteriorate.

The content of the polysiloxane needs to be 1 mass % or more and 15 mass % or less based on the total mass of the toner particles from the viewpoint of paper separability. Due to the fact that the content of the polysiloxane is 1 mass % or more, the paper separability is improved. Due to the fact that the content of the polysiloxane is set to be 15 mass % or less, the outflow of the polysiloxane to the toner surface can be prevented.

Further, the value of the ratio (Siloxane index (Ge)/Siloxane index (D)) of the siloxane index (Ge) to the following siloxane index (D) needs to be 1.0 or less. The siloxane index (Ge) and the siloxane index (D) are calculated from an FT-IR spectrum measured and obtained using a Fourier transform infrared spectroscopic analysis apparatus (manufactured by Perkin Elmer, Spectrum One). According to the ATR (Attenuated Total Reflection) method, a specimen is closely stuck to a crystal (ATR crystal) having a refractive index higher than that of the specimen, and then infrared light is caused to enter the crystal at an incidence angle equal to or higher the critical angle. Then, the incident light repeats the total reflection on the interface between the closely stuck specimen and the crystal to be emitted. Herein, the infrared light does not reflect on the interface between the specimen and the crystal and performs total reflection after slightly penetrating to the specimen side. The penetration depth depends on a wavelength, an incidence angle, and the refractive index of the ATR crystal.

$$dp=\lambda/(2\pi n1)\times[\sin 2\theta-(n1/n2)2]-½$$

dp: penetration depth n1: Refractive index of specimen (set to 1.5 in the example embodiment)

n2: Refractive index of ATR crystal (Refractive index when the ATR crystal is Ge; 4.0, Refractive index when the ATR crystal is KRS5; 2.4)

θ: Incidence angle

Therefore, FT-IR spectra different in the penetration depth can be obtained by varying the refractive index of the ATR crystal and the incidence angle.

Specifically, the siloxane index (Ge) is Pa (Ge)/Pb (Ge) when the maximum absorption peak intensity in the range of 990 $cm^{-1}$ or more and 1040 $cm^{-1}$ or less considered to be derived from Si—O of the siloxane is defined as Pa (Ge) and the maximum absorption peak intensity in the range of 1500 $cm^{-1}$ or more and 1800 $cm^{-1}$ or less considered to be derived from C(═O) of the ester group of the binding resin is defined as Pb (Ge) in an FT-IR spectrum measured and obtained using the ATR method under the conditions where Ge is used as the ATR crystal and the infrared light incidence angle is 45°. The siloxane index (Ge) is an index relating to the abundance ratio of the polysiloxane to the binding resin at about 0.7 μm from the toner particle surface in the toner particle depth direction toward the toner particle central portion from the toner particle surface. The siloxane index (D) is measured in the same manner as in the siloxane index (Ge), except using a diamond/KRS5 as the ATR crystal and is Pa (D)/Pb (D) when the maximum absorption peak intensity in the range of 990 $cm^{-1}$ or more and 1040 $cm^{-1}$ or less considered to be derived from the Si—O of the siloxane is defined as Pa (D) and the maximum absorption peak intensity in the range of 1500 $cm^{-1}$ or more and 1800 $cm^{-1}$ or less considered to be derived from the C(═O) of the ester group of the binding resin is defined as Pb (D). The siloxane index (D) is an index relating to the abundance ratio of the polysiloxane to the binding resin at about 2.0 μm from the toner particle surface in the toner particle depth direction toward the toner particle central portion from the toner particle surface. The siloxane index (Ge) shows the degree of the amount of the polysiloxane near the toner particle surface. The siloxane index (D) shows the degree of the amount of the polysiloxane including the inside of the toner particles. The siloxane index (Ge)/siloxane index (D) is a value showing the degree in which the polysiloxane is unevenly present on the surface in the toner particles. When the siloxane index (Ge)/siloxane index (D) is larger than 1.0, the polysiloxane bleeds to the surface layer of the toner particles, and therefore the flowability of the toner deteriorates.

When the content of the polysiloxane in the toner particles is defined as X, and the ratio of the siloxane index (Ge) to the siloxane index (D) is defined as Y, the product (X×Y) is the index showing the presence amount of the polysiloxane near the toner particle surface and is suitably 1.0 or more and 5.0 or less. The product (X×Y) is suitably 5.0 or less from the viewpoint of the flowability of the toner and is suitably 1.0 or more from the viewpoint of paper separability.

Each of the toner particles suitably contains a solid wax separately from the polysiloxane. The paper separability of the toner containing the polysiloxane is particularly excellent when the toner is fixed at a low temperature. As the paper separability when a solid wax is further contained, excellent performance is demonstrated due to a synergistic effect also when the toner is fixed at a high temperature.

Examples of the solid wax include, for example, low molecular weight polyolefins, such as polyethylene; ester waxes, such as stearyl stearate; plant-based waxes, such as carnauba wax, rice wax, candelilla wax, Japan tallow, and jojoba oil; animal-based waxes, such as beeswax; mineral/petroleum-based waxes, such as Montan wax, ozocerite, ceresin, paraffin wax, microcrystalline wax, Fischer Tropsch wax, and ester wax; modified substances thereof, and the like. Aliphatic hydrocarbon waxes which are the paraffin wax and the Fischer Tropsch wax are particularly suitably used. As the waxes, those having a melting point of 150° C. or less are suitable, those having a melting point of 40° C. or more and 130° C. or less are more suitable, and those having a melting point of 40° C. or more and 110° C. or less are particularly suitable.

The content of the wax is suitably 5 parts by mass or more and 20 parts by mass or less based on 100 parts by mass of the binding resin.

The wax index (Ge)/wax index (D) is suitably 1.0 or less from the viewpoint of securing the flowability of the toner. The wax index (Ge) is calculated from an FT-IR spectrum measured and obtained using a Fourier transform infrared spectroscopic analysis apparatus (manufactured by Perkin Elmer, Spectrum One) in the same manner as in the siloxane index. Specifically, a value of Pc(Ge)/Pb (Ge) when the maximum absorption peak intensity in the range of 2840 $cm^{-1}$ or more and 2860 $cm^{-1}$ or less considered to be derived from a methylene group of the wax is defined as Pc (Ge) in an FT-IR spectrum measured and obtained using the ATR method under the conditions where Ge is used as the ATR crystal and the infrared light incidence angle is 45-degree is the wax index (Ge). The wax index (Ge) is an index relating to the abundance ratio of the wax to the binding resin at about 0.2 μm from the toner particle surface in the depth direction of the toner particles toward the toner particle central portion from the toner particle surface. The wax index (D) is measured in the same manner as in the wax index (Ge), except using a diamond/KRS5 as the ATR crystal and is Pc(D)/Pb (D) when the maximum absorption peak intensity in the range of 2840 $cm^{-1}$ or more and 2860 $cm^{-1}$ or less considered to be derived from the methylene group is defined as Pc(D). The wax index (D) is an index relating to the abundance ratio of the wax to the binding resin at about 0.7 μm from the toner particle surface in the depth direction of the toner particles toward the toner particle central portion from the toner particle surface. The wax index (Ge) shows the degree of the amount of the wax near the toner particle surface. The wax index (D) shows the degree of the amount of the wax including the inside of the toner particles. The wax index (Ge)/wax index (D) is a value showing the degree in which the wax in the toner particles is unevenly present on the toner particle surface. When the wax index (Ge)/wax index (D) is larger than 1.0, the amount of the wax present near the surface of the toner particles is large, and therefore the flowability of the toner deteriorates.

Furthermore, the polysiloxane needs to be present as domains in the toner particles and the major axis of the holes derived from the polysiloxane domains in the cross section of toner particles needs to be 10 nm or more and 500 nm or less. A domain of 100 or more and 300 nm or less is more suitable. The interfacial tension between the polysiloxane and the resin is maintained by setting the major axis of the holes derived from the domains to 500 nm or less, whereby the bleeding of the polysiloxane to the surface layer can be prevented. On the other hand, when the major axis of the holes derived from the domains is smaller than 10 nm, the retention amount of the polysiloxane is insufficient, so that the separability of the toner deteriorates. A method for measuring the major axis of the holes derived from the domains is described later. The number of the domains (hereinafter also referred to as the number of the holes) present in the cross section of one toner particle is suitably 5 or more and 50 or less and more suitably 10 or more and 30 or less. When the number of the holes is smaller than 5, the retention amount of the polysiloxane is insufficient, so that the separability of the toner deteriorates. When the number of the holes is larger than 50, the strength of the toner decreases.

Moreover, each of the toner particles suitably contains crystalline polyester. In order to fix the toner at a lower temperature, a binding resin having a low softening point is suitably used. However, when those having a low softening point are used, the storage stability tends to decrease. Therefore, from the viewpoint of obtaining a toner achieving both paper separability and flowability of the toner and further achieving both low-temperature fixability and storage stability, the toner suitably contains a crystalline polyester resin having a sharp melt property in which the viscosity greatly decreases when the melting point is exceeded.

The content of the crystalline polyester is suitably 5 parts by mass or more and 30 parts by mass or less based on 100 parts by mass of the binding resin. The low-temperature fixability of the toner is improved by the sharp melt property of the crystalline polyester due to the fact that 5 parts by mass or more of the crystalline polyester is contained. On the other hand, due to the fact that 30 parts by mass or less of the crystalline polyester is contained, chargeability deterioration of the toner derived from the crystalline polyester resin can be prevented.

The structure of the crystalline polyester resin is not particularly limited and those plasticizing the binding resin at a temperature equal to or higher than the melting point are suitable. As the crystalline polyester, a structure obtained by condensation polymerization of at least one kind of dicarboxylic acid component and at least one kind of diol component can be suitably mentioned as an example. As the diol, the following substances are specifically mentioned. From the viewpoint of the ester group concentration and the melting point described below, straight chain aliphatic diols having 4 or more and 20 or less carbon atoms are suitable.

Examples of the straight chain aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,20-eicosanediol, 2-methyl-1,3-propanediol, cyclohexane diol, cyclohexane dimethanol, and the like. As the other alcohol components, aromatic diols, such as benzene dimethanol and naphthalene dimethanol, diols having tertiary carbons, such as propylene glycol, 1,2-butanediol, and 1,2-pentanediol, 1,2-hexanediol, polyhydric alcohols, such as glycerol, pentaerythritol, hexamethylolmelamine, and hexaethylolmelamine, and the like may be used as necessary. These substances may be used alone or in combination of two or more kinds thereof.

The following substances can be specifically mentioned as the dicarboxylic acid. From the viewpoint of the melting point, straight chain aliphatic dicarboxylic acids having 4 to 20 carbon atoms are suitable.

Examples of the straight chain aliphatic carboxylic acids include oxalic acid, malonic acid, maleic acid, fumaric acid, citraconic acid, itaconic acid, glutaconic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid. As the other carboxylic acid components, dicarboxylic acids having tertiary carbons, such as methyl succinic acid, ethyl succinic acid, propyl succinic acid, and butyl succinic acid, alicyclic dicarboxylic acids, such as 1,1-cyclopentenedicarboxylic acid, 1,4-cyclohexanedicarboxylic acid, 1,3-cyclohexanedicarboxylic acid, and 1,3-adamantanedicarboxylic acid, aromatic dicarboxylic acids, such as phthalic acid, isophthalic acid, terephthalic acid, p-phenylene diacetic acid, m-phenylene diacetic acid, p-phenylene dipropionic acid, m-phenylene dipropionic acid, naphthalene-1,4-dicarboxylic acid, and naphthalene-1,5-dicarboxylic acid, trivalent or higher polycarboxylic acids, such as trimellitic acid, pyromellitic acid, naphthalene tricarboxylic acid, naphthalene tetracarboxylic acid, pyrenetricarboxylic acid, and pyrenetetracarboxylic acid, and the like may be used as necessary. These substances may be used alone or in combination of two or more kinds thereof.

When the melting point of the crystalline polyester resin is excessively high, the plasticizing effect of the crystalline polyester resin decreases, so that the low-temperature fixability of the toner decreases. Therefore, the melting point of the crystalline polyester resin is suitably 50° C. or more and 100° C. or less and more suitably 60° C. or more and 80° C. or less.

As the measurement of the melting point of the crystalline polyester resin, the measurement can be performed according to ASTM D3418-82 using a differential scanning calorimeter (Manufactured by Mettler-Toledo International Inc: DSC822/EK90). Specifically, the peak temperature of the endothermic peak of the DSC curve obtained by measuring 0.01 g of a specimen in an aluminum pan, and then measuring the heat quantity while increasing the temperature of the specimen at a heating rate of 10° C./min from 0° C. to 200° C. is defined as the melting point.

The toner has a colorant. Examples of the colorant include known organic pigments or oil-based dyes, carbon black, or magnetic powder.

Specific examples of cyan colorants include a copper phthalocyanine compound and a derivative thereof, an anthraquinone compound, a basic dye lake compound, and the like. Specifically mentioned are C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62, C.I. Pigment Blue 66, and the like.

Examples of magenta colorants include a condensed azo compound, a diketopyrrolopyrrole compound, anthraquinone, a quinacridone compound, a basic dye lake compound, a naphthol compound, a benzimidazolone compound, a thioindigo compound, a perylene compound, and the like. Specifically mentioned are C.I. Pigment Red 2, C.I. Pigment Red 3, C.I. Pigment Red 5, C.I. Pigment Red 6, C.I. Pigment Red 7, C.I. Pigment Violet 19, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221, C.I. Pigment Red 254, and the like.

Examples of yellow colorants include compounds typified by a condensed azo compound, an isoindolinone compound, an anthraquinone compound, an azo metal complex, a methine compound, and an allyl amide compound, and the like. Specifically mentioned are C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 97, C.I. Pigment Yellow 109, C.I. Pigment Yellow 110, C.I. Pigment Yellow 111, C.I. Pigment Yellow 120, C.I. Pigment Yellow 127, C.I. Pigment Yellow 128, C.I. Pigment Yellow 129, C.I. Pigment Yellow 147, C.I. Pigment Yellow 151, C.I. Pigment Yellow 154, C.I. Pigment Yellow 155, C.I. Pigment Yellow 168, C.I. Pigment Yellow 174, C.I. Pigment Yellow 175, C.I. Pigment Yellow 176, C.I. Pigment Yellow 180, C.I. Pigment Yellow 181, C.I. Pigment Yellow 191, C.I. Pigment Yellow 194, and the like.

Examples of black colorants include those whose color is adjusted to black using carbon black, magnetic powder, or the yellow colorants, the magenta colorants, and the cyan colorants mentioned above.

These colorants can be used alone or as a mixture or can be used in a solid solution state. The colorants mentioned above are selected in terms of hue angle, color saturation, lightness value, lightfastness, OHP transparency, and dispersibility to a toner.

The content of the colorant is suitably 1 to 20 mass based on 100 parts by mass of the binding resin.

Method for Measuring Polysiloxane Content

The polysiloxane content can be calculated by detecting an element Si using fluorescent X-rays. Specifically, polysiloxane is mixed with the binding resin so that the polysiloxane content is 1 wt %, 10 wt %, or 20 wt % based on the total mass of a kneaded substance. Furthermore, the mixture is heated and kneaded to obtain kneaded substances 1 to 3, and then 50 mg of each kneaded substance is heat-pressed to produce kneaded substance thin films 1 to 3 of a size which allows the kneaded substance thin films 1 to 3 to be settled in an inner frame of a small amount sample measurement container described later. Toner particles and the kneaded substance thin films 1 to 3 each produce a small amount sample measurement container 10 as illustrated in FIG. 1. The small amount sample measurement container 10 is a container capable of measuring a slight amount of powder and a thin film specimen in a vacuum atmosphere and collecting the same as it is. A method for producing the small amount sample measurement container 10 is as follows. A microporous film 5 is placed on a small amount sample measurement container inner frame 2, 50 mg of toner particles or the kneaded substance thin film is further placed thereon, and then a cover film 4 covers the same. The cover film 4 is fixed with a small amount sample measurement container outer frame 1. The microporous film 5 has air permeability and allows permeation of the air between specimen particles. Moreover, the small amount sample measurement container outer frame 1 and the small amount sample measurement container inner frame 2 are formed of polyethylene, the microporous film 5 is formed of polypropylene, and the cover film 4 is formed of propylene, and all do not contain an element Si. The Kα peak angle of the element Si is 2θ=109.05 (°). Then, the pressure of a specimen chamber is reduced to be evacuated, and then the X-ray intensity of each sample can be determined under the following conditions.

Measurement Conditions:

Measurement potential, Voltage 50 kV-50 mA

2θ angle 109.05 (°)

Crystal plate PET

Measurement time 60 seconds

A calibration curve can be obtained from the polysiloxane content and the X-ray intensity of the polysiloxane in the kneaded substance thin films 1 to 3. The polysiloxane content in the toner particles can be calculated from the calibration curve and the X-ray intensity of the toner particles.

Measuring Method and Calculating Method of Pa (Ge), Pb (Ge), Pc (Ge), Pa (D), Pb (D), and Pc (D)

An FT-IR spectrum is measured by the ATR method using a Fourier transform infrared spectroscopic analyzer (Spectrum One: manufactured by PerkinElmer) having a universal ATR measurement accessory (Universal ATR Sampling Accessory). A specific measurement procedure is as follows.

The incidence angle of infrared light is set to 45°. As the ATR crystal, a Ge ATR crystal (Refractive index=4.0) and a diamond/KRS5 ATR crystal (Refractive index=2.4) are used. The other conditions are as follows.

Range

Start: 4000 $cm^{-1}$

End: 600 $cm^{-1}$ (Ge ATR crystal), 400 $cm^{-1}$ (KRS5 ATR crystal)

Duration

Scan number: 16

Resolution: 4.00 $cm^{-1}$

Advanced: $CO_2/H_2O$ with correction

Method for calculating Pa (Ge), Pb (Ge), and Pc (Ge)

(1) A Ge ATR crystal (Refractive index=4.0) is attached to an apparatus.

(2) Scan type is set to Background, Units is set to EGY, and then the background is measured.

(3) Scan type is set to Sample and Units is set to A.

(4) 0.01 g of toner particles are accurately weighed on the ATR crystal.

(5) A sample is pressurized with a pressure arm (Force Gauge is 90.).

(6) The sample is measured.

(7) The obtained FT-IR spectrum is subjected to baseline correction by Automatic Correction.

(8) The maximum value of the absorption peak intensity in the range of 990 $cm^{-1}$ or more and 1040 $cm^{-1}$ or less is calculated to be defined as Pa (Ge).

(9) The maximum value of the absorption peak intensity in the range of 1500 $cm^{-1}$ or more and 1800 $cm^{-1}$ or less is calculated to be defined as Pb (Ge).

(10) The maximum value of the absorption peak intensity in the range of 2840 $cm^{-1}$ or more and 2860 $cm^{-1}$ or less is calculated to be defined as Pc (Ge).

Method for Calculating Pa (D), Pb (D), and Pc (D)

(1) A diamond/KRS5 ATR crystal (Refractive index=2.4) is attached to an apparatus.

(2) Scan type is set to Background, Units is set to EGY, and then the background is measured.

(3) Scan type is set to Sample and Units is set to A.

(4) 0.01 g of toner particles are accurately weighed on the ATR crystal.

(5) A sample is pressurized with a pressure arm (Force Gauge is 90).

(6) The sample is measured.

(7) The obtained FT-IR spectrum is subjected to baseline correction by Automatic Correction.

(8) The maximum value of the absorption peak intensity in the range of 990 $cm^{-1}$ or more and 1040 $cm^{-1}$ or less is calculated to be defined as Pa (D).

(9) The maximum value of the absorption peak intensity in the range of 1500 $cm^{-1}$ or more and 1800 $cm^{-1}$ or less is calculated to be defined as Pb (D).

(10) The maximum value of the absorption peak intensity in the range of 2840 $cm^{-1}$ or more and 2860 $cm^{-1}$ or less is calculated to be defined as Pc (D).

Method for Measuring Major Axis of Polysiloxane Domain

The measurement was performed by performing cross-sectional processing of the toner particles, and then imaging a reflected electron image of the cross section of the toner particles with a scanning electron microscope (S-4800, manufactured by Hitachi High-Technologies Corp.). Holes (holes derived from polysiloxane domains) in which the polysiloxane domains were present inside the toner particles can be confirmed. The cross-sectional processing includes mixing the toner particles and an epoxy resin (G2 Epoxy: manufactured by GATAN), applying the mixture onto a silicon wafer and air-drying the same, and then performing platinum deposition as a conductive film. By braking the silicon wafer with the epoxy resin and the toner particles, the toner particle cross section can be exposed. A reflected electron image of the toner particle cross section is imaged using a scanning electron microscope. The polysiloxane domain portions are observed black (low luminosity) as compared with a portion where the toner components, such as the binding resin, are present because the polysiloxane flows out and no reflected electrons are emitted in the polysiloxane domain portions. After imaging the reflected electron image of the toner particle cross section, the obtained image is enlarged and printed on A3 paper, the diameter of fillets in the horizontal direction of the holes (black portions) in the toner particles is measured, and then the measured diameter is converted to the actual length from the scale on the photograph. The average value of the diameter of the fillets in the horizontal direction after the conversion in 100 toner particles is defined as the major axis of the holes derived from the polysiloxane domains in the cross section of the toner particles. The major axis of the holes derived from the polysiloxane domains can be regarded as the major axis of the polysiloxane domains in the toner particles.

Method for Measuring Average Circularity

The average circularity can be calculated using a flow type particle image meter "FPIA-3000" (manufactured by Sysmex Corp.) by performing measurement according to an operation manual of the apparatus.

A method for manufacturing a toner of the present disclosure is described. The manufacturing method is not particularly limited insofar as a toner can be manufactured in which polysiloxane is dispersed in toner particles as domains of 10 nm or more and 500 nm or less. However, when a toner containing polysiloxane is manufactured by a usual kneading and grinding method, the toner particles are broken at polysiloxane present portions in grinding, and therefore it is difficult to include the polysiloxane in the toner particles.

On the other hand, an emulsion aggregation method is suitable because a state can be formed where polysiloxane is dispersed in toner particles as domains of 10 nm or more and 500 nm or less. The emulsion aggregation method is a manufacturing method including preparing a dispersion liquid of resin fine particle having a particle diameter sufficiently smaller than the target particle diameter beforehand, and then aggregating the resin fine particles in an aqueous medium to thereby manufacture a toner. In the emulsion aggregation method, a toner is manufactured through an emulsification process, an aggregation process, a fusion process, a cooling process, and a washing process of resin fine particles. A shell forming process can be added as necessary to form a toner having a core shell structure. In the emulsion aggregation method, holes are formed between the resin fine particles aggregated in the aggregation process, and, when the resin fine particles are subjected to melt-adhesion in the fusion process, the holes are gradually filled with the resin. In this process, when the interfacial tension between the toner particles and the aqueous medium is controlled, and then the melt-adhesion process is completed when the average circularity of the toner particles falls in the range of 0.90 to 0.97, the holes can be caused to remain in the toner particles. By simultaneously aggregating a polysiloxane emulsion liquid at that time, the polysiloxane can be captured in the holes as domains.

Hereinafter, a method for manufacturing a toner using the emulsion aggregation method is more specifically described but is not limited thereto.

Emulsification Process of Resin Fine Particles

In an emulsion aggregation method, resin fine particles are prepared first. The resin fine particles can be manufactured by known methods and are suitably produced by dissolving a binding resin in an organic solvent to form a uniform solution, and then slowly adding an aqueous medium to the solution to deposit the resin to thereby produce resin fine particles. Specifically, the binding resin is dissolved in the organic solvent and, then a surfactant and a base for neutralization are added. Then, the aqueous medium is slowly added while performing stirring by a homogenizer or the like to deposit the resin fine particles. Thereafter, a solvent is removed by heating or decompressing, whereby a resin fine particle dispersion liquid is produced. The organic solvent to be used for the dissolution is not particularly limited an insofar as the resin can be dissolved.

The surfactant to be used in the emulsification is not particularly limited. For example, anionic surfactants, such as a sulfate ester salt surfactant, a sulfonate surfactant, a carboxylate surfactant, a phosphate ester surfactant, and a soap surfactant, are mentioned. Mentioned are cationic surfactants, such as an amine salt surfactant and a quaternary ammonium salt surfactant. Mentioned are nonionic surfactants, such as a polyethylene glycol surfactant, an alkylphenol ethylene oxide adduct surfactant, and a polyhydric alcohol surfactant, and the like. The surfactants may be used alone or in combination of two or more kinds thereof.

Examples of the bases to be used in the emulsification include inorganic salt groups, such as sodium hydroxide and potassium hydroxide, and organic bases, such as triethylamine, trimethylamine, dimethylaminoethanol, and diethylaminoethanol. The bases may be used alone or in combination of two or more kinds thereof.

The median size on a volume basis of the resin fine particles is suitably 0.05 μm or more and 1.0 μm or less and more suitably 0.05 μm or more and 0.4 μm or less. When the median size exceeds 1.0 μm, it becomes difficult to obtain toner particles having a median size on a volume basis of 4.0 μm or more and 7.0 μm or less which is suitable as toner particles. The median size on a volume basis is measurable by the use of a dynamic light scattering type particle size distribution meter (Nanotrac UPA-EX150: manufactured by Nikkiso).

Emulsification Process of Polysiloxane

The polysiloxane emulsion liquid to be used in the aggregation process is prepared by emulsifying the above-described polysiloxane in an aqueous medium. The polysiloxane emulsion liquid is emulsified by known methods. For example, media type dispersion machines, such as a rotation shearing type homogenizer, a ball mill, a sand mill, and an attritor, a high-pressure counter collision type dispersion machine, and the like are suitably used. Specifically, 5 mass % or more and 40 mass % or less of polysiloxane based on the total mass of an emulsion liquid is mixed in an aqueous medium, and then a surfactant is added. Thereafter, shearing is given to the aqueous medium containing the polysiloxane for emulsification using the disperser mentioned above. The surfactant to be used in the emulsification is not particularly limited. For example, anionic surfactants, such as a sulfate ester salt surfactant, a sulfonate surfactant, a carboxylate surfactant, a phosphate ester surfactant, and a soap surfactant, are mentioned. Mentioned are cationic surfactants, such as an amine salt surfactant and a quaternary ammonium salt surfactant. Mentioned are nonionic surfactants, such as a polyethylene glycol surfactant, an alkylphenol ethylene oxide adduct surfactant, and a polyhydric alcohol surfactant, and the like. The surfactants may be used alone or in combination of two or more kinds thereof. The median size on a volume basis of the polysiloxane emulsified particles in the polysiloxane emulsion liquid is suitably 0.05 μm or more and 0.5 μm or less and more suitably 0.05 μm or more and 0.4 μm or less. When the median size exceeds 0.5 μm, it becomes difficult to capture the same in the holes of the toner particles, so that the bleed amount to the surface increases. The median size on a volume basis can be measured by the use of a dynamic light scattering type particle size distribution meter (Nanotrac UPA-EX150: manufactured by Nikkiso).

Aggregation Process

The aggregation process includes mixing the resin fine particles and the emulsion liquid of polysiloxane finely dispersed in an aqueous medium described above and further colorant fine particles and wax fine particles as necessary to prepare a mixed liquid. Subsequently, the aggregation process includes aggregating the particles contained in the prepared mixed liquid and the emulsified particles of the polysiloxane emulsion liquid to form an aggregate. As a method for forming the aggregate, an aggregating agent is added to and mixed with the mixed liquid, and then applying temperature, mechanical power, and the like as appropriate can be suitably mentioned, for example.

Colorant fine particles to be used in the aggregation process are prepared by dispersing the above-described colorant. The colorant fine particles are dispersed by known methods. For example, media type dispersion machines, such as a rotation shearing type homogenizer, a ball mill, a sand mill, and an attritor, a high-pressure counter collision type dispersion machine, and the like are suitably used. Moreover, a surfactant and a polymer dispersant imparting dispersion stability can be added as necessary.

The wax fine particles to be used in the aggregation process are prepared by dispersing the above-described wax in an aqueous medium. The wax is dispersed by known methods. For example, media type dispersion machines, such as a rotation shearing type homogenizer, a ball mill, a sand mill, and an attritor, a high-pressure counter collision type dispersion machine, and the like are suitably used. Moreover, a surfactant and a polymer dispersant imparting dispersion stability can be added as necessary.

Examples of the aggregating agent to be used in the aggregation process include metal salts of monovalent metals, such as sodium and potassium; metal salts of divalent metals, such as calcium and magnesium; metal salts of trivalent metals, such as iron and aluminum, for example.

The addition/mixing of the aggregating agent is suitably performed at a temperature equal to or lower than the glass transition temperature (Tg) of the resin fine particles contained in the mixed liquid. When the mixing is performed under the temperature conditions, the aggregation proceeds in a stabilized state. The mixing can be performed using a known mixing device, a homogenizer, a mixer, or the like.

The average particle diameter of the aggregate formed in the aggregation process is not particularly limited and, in usual, may be controlled to be 4.0 μm or more and 7.0 μm or less in order to be approximately the same as the average particle diameter of toner particles to be obtained. In It is suitable to increase the particle diameter formation speed of the aggregate because there is a necessity of forming holes in the toner particles. Specifically, the aggregation is suitably performed with an aggregation time, in which the toner particles grow to reach the toner particle diameter to be obtained, of 10 minutes or more and 60 minutes or less. By setting the aggregation time to 60 minutes or less, a coarse aggregate is formed. By performing heating in a fusion process described below, holes are formed in the toner particles. The particle diameter formation speed of the aggregate can be controlled by the temperature in the aggregation. The particle size distribution of the toner particles can be measured with a particle size distribution analyzer (Coulter Multisizer III: manufactured by Coulter) employing a Coulter method.

Fusion Process

The fusion process is a process including heating the aggregate to a temperature equal to or higher than the glass transition point (Tg) of resin for melt-adhesion of fine particles forming the aggregate to thereby manufacture particles without a boundary between the fine particles. Before the fusion process, a chelating agent, a pH adjuster, a surfactant, and the like can be charged as appropriate in order to prevent melt-adhesion between the toner particles.

Examples of the chelating agent include alkali metal salts, such as ethylenediaminetetraacetic acid (EDTA) and a Na salt thereof, sodium gluconate, sodium tartrate, potassium citrate and sodium citrate, nitrotriacetate (NTA) salt, and a large number of water-soluble polymers (polyelectrolytes) including both functional groups COOH and OH.

The heating temperature may be a temperature between the glass transition temperature (Tg) of the binding resin contained in the aggregate and a temperature at which the binding resin is thermally decomposed. When the heating temperature is high, a short heating/fusion time is enough. When the heating temperature is low, a long heating/fusion time is required. More specifically, the heating/fusion time depends on the heating temperature, and therefore cannot be unconditionally specified but the heating/fusion time is generally 10 minutes to 10 hours.

In the fusion process, the circularity of the toner particles is suitably controlled to 0.90 or more and 0.97 or less as described above. By controlling the circularity of the toner particles in the range mentioned above, it becomes easy to hold the holes formed in the toner particles in 10 to 500 nm domains. As the control of the circularity, the circularity is controllable by the heating time and the heating temperature as described above.

The toner particles suitably have fine concavities and convexities of 100 nm or more and 500 nm or less on the surface. When the polysiloxane included in the toner particles bleeds to a surface layer, the polysiloxane can be held in concave portions of the fine concavities and convexities, so that flowability deterioration can be prevented. In the aggregation process, the acid value of the resin forming the fine particles and the addition amount of the chelating agent and the surfactant are adjusted so that the surfaces of the fine particles of the outermost layer of the aggregate are repulsive to each other. Thus, the aggregate surface layer does not become smooth also in the fusion process and toner particles having fine concavities and convexities on the surface layer can be obtained.

Cooling Process

The cooling process is a process of reducing the temperature of the aqueous medium containing the particles to a temperature lower than the glass transition point (Tg) of the resin. Unless the cooling is performed so that the temperature reaches a temperature lower than the Tg, coarse particles are formed. A specific cooling rate is 0.1° C./min or more and 150° C./min or less.

Washing and Drying Process

The particles produced through the above-described processes are washed, filtered, and dried, for example, whereby toner particles can be obtained. Thereafter, drying is performed, and, as necessary, inorganic powder, such as silica, alumina, titania, and calcium carbonate, and resin particles, such as vinyl-based resin, polyester resin, and silicone resin, may be added while applying shearing force in a dry state. These inorganic powder and resin particles function as external additives, such as a fluidity assistant and a cleaning assistant.

Shell Forming Process

Moreover, a shell forming process can be provided as necessary before the washing and drying process after the aggregation process. The shell forming process is a process including newly adding and attaching resin fine particles to the particles (hereinafter also referred to as core particles) produced in the processes so far to form a shell. The acid value of the resin fine particles forming the shell is suitably lower than the acid value of a resin forming a core.

By setting the acid value of the resin forming a shell to be lower, charge repulsion of shell particles decreases in the fusion process. As a result, the shell forming the surface in the fusion process is more easily transformed than the core, and then the surface is smoothened first, which makes it easy to hold the holes inside the toner particles. The resin forming such a shell layer is not particularly limited and known resin for use in toner particles, e.g., vinyl-based polymers, such as polyester resin and a styrene-acryl copolymer, epoxy resin, polycarbonate resin, polyurethane resin, and the like are usable.

The resin forming the shell layer may be used alone or may be used in combination of two or more kinds thereof.

EXAMPLES

Hereinafter, Examples and Comparative Examples are described in more detail but aspects of the invention are not particularly limited thereto. "Part(s)" and "%" in Examples and Comparative Examples are all on a mass basis unless otherwise particularly specified.

Manufacturing of Binding Resin Emulsion Liquid 1

Tetrahydrofuran (manufactured by Wako Pure Chemical Industries, Ltd.) 200 g

Polyester resin A 120 g

[Composition (mol %) [2, 2-bis(4-hydroxyphenyl)propane: isophthalic acid=00:100], Number average molecular weight (Mn)=3,000, Weight average molecular weight (Mw)=12,500, Peak molecular weight (Mp)=8,000, Mw/Mn=4.2, Softening temperature (Tm)=123° C., Glass transition temperature (Tg)=68° C., Acid value=24 mgKOH/g]

Anionic surfactant (manufactured by Daiichi Kogyo Seiyaku Co., Ltd.: NEOGEN RK) 0.6 g The substances above were mixed, and then stirred for 12 hours to dissolve the resin.

Subsequently, 2.7 g of N,N-dimethylaminoethanol was added, and then stirred at 4000 rpm using an ultrahigh speed stirring device T.K. Robomix (manufactured by PRIMIX Corporation).

Furthermore, 360 g of ion exchanged water was added at a rate of 1 g/min to deposit resin fine particles. Then, the tetrahydrofuran was removed using an evaporator to obtain amorphous resin fine particles 1 and a dispersion liquid thereof.

The 50% particle diameter (d50) on a volume distribution basis of the amorphous resin fine particles 1 was 0.11 μm as measured using a dynamic light scattering type particle size distribution meter (Nanotrac: manufactured by Nikkiso).

Manufacturing of Binding Resin Emulsion Liquid 2

Tetrahydrofuran (manufactured by Wako Pure Chemical Industries, Ltd.) 200 g

Polyester resin B 120 g

[Composition (mol %) [Polyoxypropylene(2.2)-2,2-bis(4-hydroxyphenyl)propane:isophthalic acid:terephthalic acid=100:50:50], Number average molecular weight (Mn)=4,600, Weight average molecular weight (Mw)=16,500, Peak molecular weight (Mp)=10,400, Mw/Mn=3.6, Softening temperature (Tm)=122° C., Glass transition temperature (Tg)=70° C., Acid value=10 mgKOH/g]

Anionic surfactant (manufactured by Daiichi Kogyo Seiyaku Co., Ltd.: NEOGEN RK) 0.6 g The substances above were mixed, and then stirred for 12 hours to dissolve the resin.

Subsequently, 2.7 g of N,N-dimethylaminoethanol was added, and then stirred at 4000 rpm using an ultrahigh speed stirring device T.K. Robomix (manufactured by PRIMIX Corporation).

Furthermore, 360 g of ion exchanged water was added at a rate of 1 g/min to deposit resin fine particles. Thereafter, the tetrahydrofuran was removed using an evaporator to obtain amorphous resin fine particles 2 and a dispersion liquid thereof.

The 50% particle diameter (d50) on a volume distribution basis of the amorphous resin fine particles 2 was 0.10 μm as measured using a dynamic light scattering type particle size distribution meter (Nanotrac: manufactured by Nikkiso).

Manufacturing of Polysiloxane Emulsion Liquid

Dimethyl polysiloxane (manufactured by Shin-Etsu Chemical Co., Ltd.: KF965) 30 g Anionic surfactant (manufactured by Daiichi Kogyo Seiyaku Co., Ltd.: NEOGEN RK) 4.5 g Ion exchanged water 265.5 g The substances above were mixed, and then stirred at 4000 rpm using an ultrahigh speed stirring device T.K. Robomix (manufactured by PRIMIX Corporation) to thereby prepare an emulsion liquid of the dimethylpolysiloxane. The 50% particle diameter (d50) on a volume distribution basis of oil droplets of the obtained emulsified particles of the dimethylpolysiloxane was 0.15 μm as measured using a dynamic light scattering type particle size distribution meter (Nanotrac: manufactured by Nikkiso).

Manufacturing of Crystalline Resin Emulsion Liquid

Tetrahydrofuran (manufactured by Wako Pure Chemical Industries, Ltd.) 200 g

Crystalline polyester resin C 120 g

[Composition (mol %) [1,9-nonanediol:sebacic acid=100:100], Number average molecular weight (Mn)=5,500, Weight average molecular weight (Mw)=15,500, Peak molecular weight (Mp)=11,400, Mw/Mn=2.8, Melting point=78° C., Acid value=13 mgKOH/g] Anionic surfactant (manufactured by Daiichi Kogyo Seiyaku Co., Ltd.: NEOGEN RK) 0.6 g The substances above were mixed, heated to 50° C., and then stirred for 3 hours to dissolve the resin.

Subsequently, 2.7 g of N,N-dimethylaminoethanol was added, and then stirred at 4000 rpm using an ultrahigh speed stirring device T.K. Robomix (manufactured by PRIMIX Corporation).

Furthermore, 360 g of ion exchanged water was added at a rate of 1 g/min to deposit resin fine particles. Then, the tetrahydrofuran was removed using an evaporator to obtain crystalline resin fine particles 1 and a dispersion liquid thereof.

The 50% particle diameter (d50) on a volume distribution basis of the crystalline resin fine particles 1 was 0.30 μm as measured using a dynamic light scattering type particle size distribution meter (Nanotrac: manufactured by Nikkiso).

Manufacturing of Colorant Fine Particles

Colorant 10.0 parts by mass (Cyan pigment, manufactured by Dainichiseika Color & Chemicals Mfg. Co., Ltd.: Pigment Blue 15:3)

Anionic surfactant (manufactured by Daiichi Kogyo Seiyaku Co., Ltd.: NEOGEN RK) 1.5 parts by mass
Ion exchanged water 88.5 parts by mass The substances above were mixed, dissolved, dispersed for about 1 hour using a high pressure impact type disperser Nanomizer (manufactured by yoshida kikai co., ltd) to prepare a dispersion liquid of colorant fine particles in which the colorant was dispersed.

The 50% particle diameter (d50) on a volume distribution basis of the obtained colorant fine particles was 0.20 μm as measured using a dynamic light scattering type particle size distribution meter (Nanotrac: manufactured by Nikkiso).

Manufacturing of Wax Fine Particles

Wax (HNP-51, Melting point of 78° C., manufactured by NIPPON SEIRO) 20.0 parts by mass
Anionic surfactant (manufactured by Daiichi Kogyo Seiyaku Co., Ltd.: NEOGEN RK) 1.0 part by mass
Ion exchanged water 79.0 parts by mass The substances above were charged into a mixing vessel with a stirring device, heated to 90° C., and then stirred for 60 minutes with a shear-stirring portion having a rotor outer diameter of 3 cm and a clearance of 0.3 mm under the conditions where the number of rotations of the rotor was 19000 rpm and the number of rotations of a screen was 19000 rpm while circulating to a CLEARMIX W-MOTION (manufactured by M Technique) for dispersion treatment.

Thereafter, the resultant substance was cooled to 40° C. under the cooling conditions where the number of rotations of the rotor was 1000 rpm, the number of rotations of the screen was 0 rpm, and the cooling rate was 10° C./min, whereby a dispersion liquid of wax fine particles was obtained.

The 50% particle diameter (d50) on a volume distribution basis of the wax fine particles was 0.15 μm as measured using a dynamic light scattering type particle size distribution meter (Nanotrac: manufactured by Nikkiso).

Example 1

Manufacturing of Toner Particles 1

Emulsion liquid of amorphous resin fine particles 1 320 parts by mass
Emulsion liquid of dimethylpolysiloxane 50 parts by mass
Emulsion liquid of crystalline resin fine particles 80 parts by mass
Dispersion liquid of colorant fine particles 50 parts by mass
Dispersion liquid of wax fine particles 50 parts by mass
Ion exchanged water 400 parts by mass The materials above were charged into a stainless steel round bottom flask, and then mixed. Thereafter, an aqueous solution in which 2 parts by mass of magnesium sulfate was dissolved in 98 parts by mass of ion exchanged water was added thereto, and then the mixture was dispersed for 10 minutes at 5000 rpm using a homogenizer (manufactured by IKA: ULTRA-TURRAX T50).

Thereafter, the resultant substance was heated to 65° C. using a stirring blade in a water bath for heating while adjusting, as appropriate, the number of rotations so that the mixed liquid was stirred. The resultant substance was held at 65° C. for 15 minutes to obtain aggregated particles having a volume average particle diameter of about 6.0 μm.

An aqueous solution in which 20 parts by mass of tetrasodium ethylenediaminetetraacetate was dissolved in 380 parts by mass of ion exchanged water was added to a dispersion liquid containing the aggregated particles, and then heated to 85° C.

The resultant substance was held at 85° C. for 2 hours, so that toner particles having a volume average particle diameter of about 5.6 μm and an average circularity of 0.955 were obtained.

The volume average particle diameter of the particles was measured using a Coulter Multisizer III (manufactured by Coulter) according to an operation manual of the apparatus. The average circularity was measured and calculated using a flow type particle image meter "FPIA-3000" (manufactured by Sysmex Corp.) according to an operation manual of the apparatus.

Figure 2:
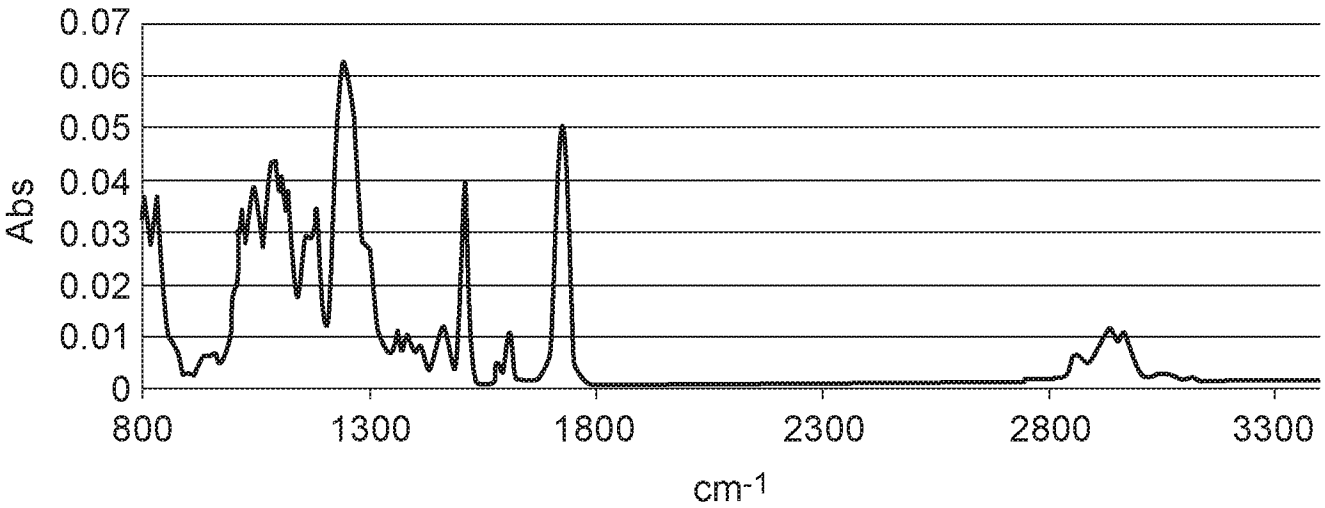
FIG. 2 is an example of an ATR spectrum of toner particles when Ge is used as an ATR crystal.
Figure 3:
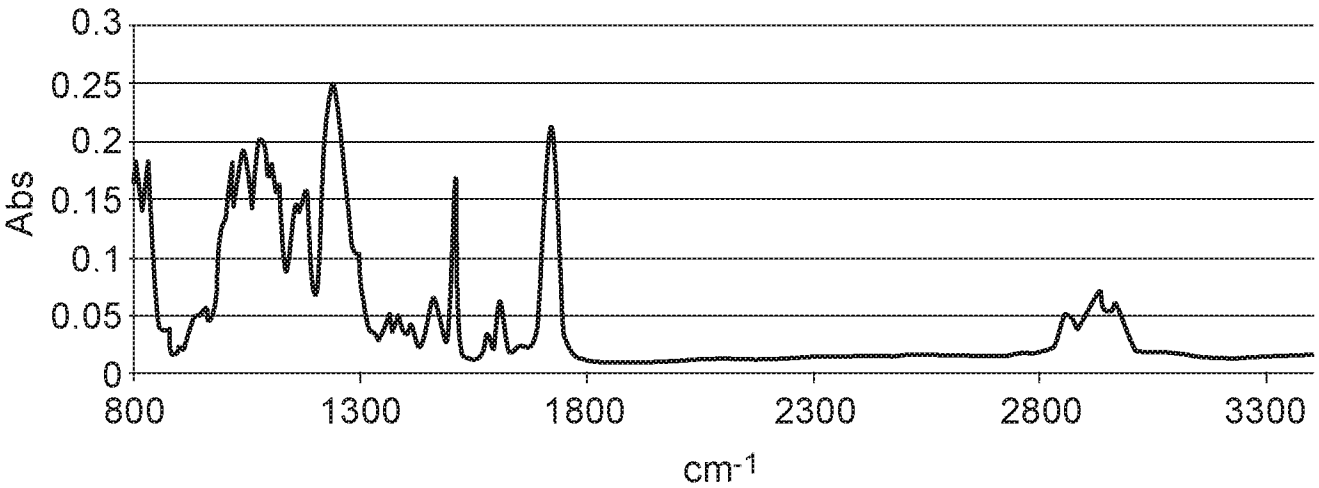
FIG. 3 is an example of an ATR spectrum of the toner particles when a diamond/KRS5 is used as the ATR crystal.

Thereafter, filtration/solid-liquid separation was performed. Then, a filtered product was sufficiently washed with ion exchanged water, and then dried using a vacuum dryer, whereby toner particles 1 having a volume average particle diameter of 5.2 μm were obtained. When a reflected electron image of the surface layer of the toner particles 1 was confirmed using a scanning electron microscope, fine concavities and convexities of 100 nm to 500 nm were not able to be confirmed on the surface of the toner particles 1. When the siloxane index (Ge) and the wax index (Ge) were determined from the ATR spectrum (FIG. 2) measured by the above-described method using Ge as the ATR crystal, the siloxane index (Ge) was 0.72 and the wax index (Ge) was 0.13. When the siloxane index (D) and the wax index (D) were determined from the ATR spectrum (FIG. 3) measured by the above-described method using a diamond/KRS5 as the ATR crystal, the siloxane index (D) was 0.90 and the wax index (D) thereof was 0.23. Furthermore, when the size of the holes of the toner particles 1 was confirmed using the above-described cross-sectional observation method, the average value of the hole sizes was 159 nm. The formulation and the characteristics of the toner particles 1 are shown in Table.

Example 2

Manufacturing of Toner Particles 2

Toner particles 2 were obtained in the same manner as in Example 1, except changing tetrasodium ethylenediaminetetraacetate to 10 parts by mass. The average circularity of the obtained toner particles was 0.952 and the volume average particle diameter thereof was 5.5 μm. When a reflected electron image of the surface layer of the toner particles 2 was confirmed using a scanning electron microscope, fine concavities and convexities of 200 nm were confirmed on the surface of the toner particles 2. When the siloxane index and the wax index were determined using the above-described measuring method, the siloxane index (Ge) of the toner particles 2 was 0.70, the siloxane index (D) thereof was 0.86, the wax index (Ge) thereof was 0.12, and the wax index (D) thereof was 0.21. Furthermore, when the size of the holes of the toner particles 2 was confirmed using the above-described cross-sectional observation method, the average value of the hole sizes was 157 nm. The formulation and the characteristics of the toner particles 2 are shown in Table.

Example 3

Manufacturing of Toner Particles 3

Toner particles 3 were obtained in the same manner as in Example 2, except changing the emulsion liquid of the amorphous resin fine particles 1 to the emulsion liquid of the amorphous resin fine particle 2. The average circularity of the obtained toner particles was 0.954 and the volume average particle diameter thereof was 5.5 μm. When a reflected electron image of the surface layer of the toner particles 3 was confirmed using a scanning electron microscope, fine concavities and convexities of 200 nm was confirmed on the surface of the toner particles 3. When the siloxane index and the wax index were determined using the above-described measuring method, the siloxane index (Ge) of the toner particles 3 was 1.26, the siloxane index (D) thereof was 1.42, the wax index (Ge) thereof was 0.12, and the wax index (D) thereof was 0.16. Furthermore, when the size of the holes of the toner particles 3 was confirmed using the above-described cross-sectional observation method, the average value of the hole sizes was 160 nm. The formulation and the characteristics of the toner particles 3 are shown in Table.

Example 4

Manufacturing of Toner Particles 4

Emulsion liquid of amorphous resin fine particles 1 320 parts by mass
Emulsion liquid of dimethylpolysiloxane 50 parts by mass
Emulsion liquid of crystalline resin fine particles 80 parts by mass
Dispersion liquid of colorant fine particles 50 parts by mass
Ion exchanged water 400 parts by mass The materials above were charged into a stainless steel round bottom flask, and then mixed. Thereafter, an aqueous solution in which 2 parts by mass of magnesium sulfate was dissolved in 98 parts by mass of ion exchanged water was added thereto, and then the mixture was dispersed for 10 minutes at 5000 rpm using a homogenizer (manufactured by IKA: ULTRA-TURRAX T50).

Thereafter, the resultant substance was heated to 65° C. using a stirring blade in a water bath for heating while adjusting, as appropriate, the number of rotations so that the mixed liquid was stirred. The resultant substance was held at 65° C. for 15 minutes to obtain aggregated particles having a volume average particle diameter of about 6.0 μm.

An aqueous solution in which 20 parts by mass of tetrasodium ethylenediaminetetraacetate was dissolved in 380 parts by mass of ion exchanged water was added to a dispersion liquid containing the aggregated particles, and then heated to 85° C.

The resultant substance was held at 85° C. for 2 hours, so that toner particles having a volume average particle diameter of about 5.8 μm and an average circularity of 0.951 were obtained.

The volume average particle diameter of the particles was measured using a Coulter Multisizer III (manufactured by Coulter) according to an operation manual of the apparatus. The average circularity was measured and calculated using a flow type particle image meter "FPIA-3000" (manufactured by Sysmex Corp.) according to an operation manual of the apparatus.

Thereafter, filtration/solid-liquid separation was performed. Then, a filtered product was sufficiently washed with ion exchanged water, and then dried using a vacuum dryer, whereby toner particles 4 having a volume average particle diameter of 5.4 μm were obtained. When a reflected electron image of the surface layer of the toner particles 4 was confirmed using a scanning electron microscope (manufactured by Hitachi High-Technologies Corp., S-4800), fine concavities and convexities of 100 nm to 500 nm were not able to be confirmed on the surface of the toner particles 4. When the siloxane index was determined using the above-described measuring method, the siloxane index (Ge) of the toner particles 4 was 0.68 and the siloxane index (D) thereof was 0.85. Furthermore, when the size of the holes of the toner particles 4 was confirmed using the above-described cross-sectional observation method, the average value of the hole sizes was 174 nm. The formulation and the characteristics of the toner particles 4 are shown in Table.

Example 5

Manufacturing of Toner Particles 5

Toner particles 5 were obtained in the same manner as in Example 4, except changing the emulsion liquid of dimethylpolysiloxane to 100 parts by weight. The average circularity of the obtained toner particles was 0.954 and the volume average particle diameter thereof was 5.5 μm. When a reflected electron image of the surface layer of the toner particles 5 was confirmed using a scanning electron microscope, fine concavities and convexities of 100 nm to 500 nm were not able to be confirmed on the surface of the toner particles 5. When the siloxane index was determined using the above-described measuring method, the siloxane index (Ge) of the toner particles 5 was 1.10 and the siloxane index (D) thereof was 1.51. Furthermore, when the size of the holes of the toner particles 5 was confirmed using the above-described cross-sectional observation method, the average value of the hole sizes was 187 nm. The formulation and the characteristics of the toner particles 5 are shown in Table.

Comparative Example 1

Manufacturing of Toner Particles 6

Toner particles 6 were obtained in the same manner as in Example 2, except not using the emulsion liquid of dimethylpolysiloxane. The average circularity of the obtained toner particles was 0.955 and the volume average particle diameter thereof was 5.4 μm. When a reflected electron image of the surface layer of the toner particles 6 was confirmed using a scanning electron microscope, fine concavities and convexities of 100 nm to 500 nm were not able to be confirmed on the surface of the toner particles 6. When the wax index was determined using the above-described measuring method, the wax index (Ge) of the toner particles 6 was 0.12 and the wax index (D) thereof was 0.20. Furthermore, when the size of the holes of the toner particles 6 was confirmed using the above-described cross-sectional observation method, the average value of the hole sizes was 160 nm. The formulation and the characteristics of the toner particles 6 are shown in Table.

Comparative Example 2

Manufacturing of Toner Particles 7

Toner particles 7 were obtained in the same manner as in Example 4, except changing the retention time after heating a water bath for heating to 85° C. to 5 hours. The average circularity of the obtained toner particles was 0.980 and the volume average particle diameter thereof was 5.4 μm. When a reflected electron image of the surface layer of the toner particles 7 was confirmed using a scanning electron microscope, fine concavities and convexities of 100 nm to 500 nm were not able to be confirmed on the surface of the toner particles 1. When the siloxane index was determined using the above-described measuring method, the siloxane index (Ge) of the toner particles 7 was 0.81 and the siloxane index (D) thereof was 0.59. Furthermore, when the size of the holes of the toner particles 7 was confirmed using the above-described cross-sectional observation method, no holes were able to be confirmed in the toper particles. The formulation and the characteristics of the toner particles 7 are shown in Table.

Comparative Example 3

Manufacturing of Toner Particles 8

Toner particles 8 were obtained in the same manner as in Example 4, except changing the retention time after heating a water bath for heating to 85° C. to 5 minutes. The average circularity of the obtained toner particles was 0.928 and the volume average particle diameter thereof was 5.5 μm. When a reflected electron image of the surface layer of the toner particles 8 was confirmed using a scanning electron microscope, fine concavities and convexities of 100 nm to 500 nm were not able to be confirmed on the surface of the toner particles 8. When the siloxane index was determined using the above-described measuring method, the siloxane index (Ge) of the toner particles 8 was 0.68 and the siloxane index (D) thereof was 0.85. Furthermore, when the size of the holes of the toner particles 8 was confirmed using the above-described cross-sectional observation method, the average value of the hole sizes was 1030 nm.

Comparative Example 4

Manufacturing of Toner Particles 9

Toner particles 9 were obtained in the same manner as in Example 4, except changing the emulsion liquid of dimethylpolysiloxane to 5 parts by weight. The average circularity of the obtained toner particles was 0.955 and the volume average particle diameter thereof was 5.6 μm. When a reflected electron image of the surface layer of the toner particles 9 was confirmed using a scanning electron microscope, fine concavities and convexities of 100 nm to 500 nm were not able to be confirmed on the surface of the toner particles 9. When the siloxane index was determined using the above-described measuring method, the siloxane index (Ge) of the toner particles 9 was 0.08 and the siloxane index (D) thereof was 0.12. Furthermore, when the size of the holes of the toner particles 9 was confirmed using the above-described cross-sectional observation method, the average value of the hole sizes was 80 nm. The formulation and the characteristics of the toner particles 9 are shown in Table.

Comparative Example 5

Manufacturing of Toner Particles 10

Toner particles 10 were obtained in the same manner as in Example 4, except changing the emulsion liquid of dimethylpolysiloxane to 200 parts by weight. The average circularity of the obtained toner particles was 0.953 and the volume average particle diameter thereof was 5.6 μm. When a reflected electron image of the surface layer of the toner particles 10 was confirmed using a scanning electron microscope, fine concavities and convexities of 100 nm to 500 nm were not able to be confirmed on the surface of the toner particles 10. When the siloxane index was determined using the above-described measuring method, the siloxane index (Ge) of the toner particles 10 was 2.72 and the siloxane index (D) thereof was 3.17. Furthermore, when the size of the hole of the toner particles 10 was confirmed using the above-described cross-sectional observation method, the average value of the hole sizes was 239 nm. The formulation and the characteristics of the toner particles 10 are shown in Table.

Comparative Example 6

Manufacturing of Toner Particles 11

Polyester A 80 parts by mass

Dimethylpolysiloxane (manufactured by Shin-Etsu Chemical Co., Ltd.: KF965) 5 parts by mass Crystalline polyester C 20 parts by mass Colorant 5 parts by mass (Cyan pigment, manufactured by Dainichiseika Color & Chemicals Mfg. Co., Ltd.: Pigment Blue 15:3)

The raw materials above were preliminarily mixed with a Henschel mixer, and then kneaded for 1 hour with a twin screw kneading extruder (PCM-30: manufactured by Ikegai Iron Works, Ltd.) set to 130° C. and 200 rpm.

The obtained kneaded substance was cooled, and then roughly ground with a cutter mill. Thereafter, the obtained roughly ground substances were finely ground with a turbo mill T-250 (manufactured by Turbo Kogyo Co., Ltd), and then classified using a multi-division classifier utilizing the Coanda effect to obtain toner particles 11. The average circularity of the obtained toner particles was 0.932 and the volume average particle diameter thereof was 6.0 μm. When a reflected electron image of the surface layer of the toner particles 11 was confirmed using a scanning electron microscope, fine concavities and convexities of 100 nm to 500 nm were not able to be confirmed on the surface of the toner particles 11. When the siloxane index was determined using the above-described measuring method, the siloxane index (Ge) of the toner particles 11 was 1.31 and the siloxane index (D) thereof was 0.71. Furthermore, when the above-described cross-sectional observation method was performed, no holes were confirmed in the toner particles 11. The formulation and the characteristics of the toner particles 11 are shown in Table.

Toner Characteristic Evaluation

The following evaluations were carried out using the toner particles 1 to 11. The results are shown in Table.

For the evaluation, a toner was used to which an external additive was externally added by dry-mixing 1.8 parts by mass of silica fine particles having a specific surface area measured by a BET method of 200 $m^2/g$ and subjected to hydrophobization treatment with silicone oil with 100 parts by mass of the toner particles with a Henschel mixer (manufactured by Mitsui Mining).

Evaluation of Flowability of Toner

The toner was allowed to stand still in a thermohygrostat for 3 days, and then the amount of the toner remaining on a sieve having an opening of 75 μm when sieved using the sieve for 300 seconds at a shaking width of 1 mm was evaluated according to the following criteria.

Evaluation Criteria

○: The amount of the toner remaining on the sieve after allowed to stand still for 3 days in a thermohygrostat of a temperature of 55° C. and a humidity of 10% RH, and then sieved is 10% or less.

Δ: The amount of the toner remaining on the sieve after allowed to stand still for 3 days in a thermohygrostat of a temperature of 55° C. and a humidity of 10% RH, and then sieved is 10% or more but the amount of the toner remaining on the sieve after allowed to stand still for 3 days in a thermohygrostat of a temperature of 50° C. and a humidity of 10% RH, and then sieved is 10% or less.

x: The amount of the toner remaining on the sieve after allowed to stand still for 3 days in a thermohygrostat of a temperature of 50° C. and a humidity of 10% RH, and then sieved is 10% or more.

Evaluation of Paper Separability of Toner

The toner to which an external additive was externally added and a ferrite carrier (Average particle diameter of 42 μm) whose surface was coated with a silicone resin were mixed so that the toner concentration was 8 mass % to prepare a two-component developing agent. The two-component developing agent was charged into a commercially-available full color digital copier (CLC1100, manufactured by CANON KABUSHIKI KAISHA), and then an unfixed toner image (0.6 mg/cm$^2$) was formed on an image receiving paper (64 g/m$^2$). A fixing unit removed from the commercially-available full color digital copier (imageRUNNER ADVANCE C5051, manufactured by CANON KABUSHIKI KAISHA) was converted so that the fixing temperature was adjustable, and then a paper separation unit was further removed. A paper separability evaluation test of the unfixed toner image was performed using the same. It was visually observed whether the unfixed toner image was wound around a fixing roller when fixed under normal temperature and normal humidity while setting the process speed to 246 mm/sec.

Paper Separability Evaluation Criteria

○: When the fixing was attempted at 140° C. and 200° C., the unfixed toner image was not wound around the fixing roller.

Δ: When the fixing was attempted at 140° C., the unfixed toner image was not wound around the fixing roller but when the fixing was attempted at 200° C., the unfixed toner image was wound around the fixing roller.

x: When the fixing was attempted at 140° C., the unfixed toner image was wound around the fixing roller.

TABLE

| | Toner No. | Toner manufacturing method | Amorphous resin | Polysiloxane amount | Solid mold release agent amount | Crystalline resin | Circularity | Siloxane index (Ge)/ Siloxane index (D) |
|---|---|---|---|---|---|---|---|---|
| Example 1 | 1 | Emulsion aggregation | Binding resin 1 | 5 parts by weight | 5 parts by weight | Crystalline PES | 0.955 | 0.80 |
| Example 2 | 2 | Emulsion aggregation | Binding resin 1 | 5 parts by weight | 5 parts by weight | Crystalline PES | 0.952 | 0.81 |
| Example 3 | 3 | Emulsion aggregation | Binding resin 2 | 5 parts by weight | 5 parts by weight | Crystalline PES | 0.954 | 0.89 |
| Example 4 | 4 | Emulsion aggregation | Binding resin 1 | 5 parts by weight | — | Crystalline PES | 0.951 | 0.80 |
| Example 5 | 5 | Emulsion aggregation | Binding resin 1 | 10 parts by weight | — | Crystalline PES | 0.954 | 0.73 |
| Comparative Example 1 | 6 | Emulsion aggregation | Binding resin 1 | — | 5 parts by weight | Crystalline PES | 0.955 | — |
| Comparative Example 2 | 7 | Emulsion aggregation | Binding resin 1 | 5 parts by weight | | Crystalline PES | 0.980 | 1.37 |
| Comparative Example 3 | 8 | Emulsion aggregation | Binding resin 1 | 5 parts by weight | — | Crystalline PES | 0.928 | 0.80 |
| Comparative Example 4 | 9 | Emulsion aggregation | Binding resin 1 | 0.5 parts by weight | — | Crystalline PES | 0.955 | 0.67 |
| Comparative Example 5 | 10 | Emulsion aggregation | Binding resin 1 | 20 parts by weight | — | Crystalline PES | 0.953 | 0.86 |
| Comparative Example 6 | 11 | Kneading/ Grinding | Binding resin 1 | 5 parts by weight | — | Crystalline PES | 0.932 | 1.85 |

| | (Polysiloxane content) × Siloxane index (Ge)/Siloxane index (D) | Mold release agent index (Ge)/Mold release agent index (D) | Hole size inside toner | Fine concavities and convexities on toner surface | Toner flowability | Paper separability |
|---|---|---|---|---|---|---|
| Example 1 | 4.0 | 0.57 | 159 nm | Not observed | Δ | ○ |
| Example 2 | 4.1 | 0.57 | 157 nm | Observed | ○ | ○ |
| Example 3 | 4.5 | 0.75 | 160 nm | Observed | ○ | ○ |
| Example 4 | 4.0 | — | 174 nm | Not observed | Δ | Δ |
| Example 5 | 7.3 | — | 187 nm | Not observed | Δ | Δ |
| Comparative Example 1 | | 0.60 | 160 nm | Not observed | Δ | x |
| Comparative Example 2 | 6.9 | — | — | Not observed | x | Δ |
| Comparative Example 3 | 4.0 | — | 1030 nm | Not observed | x | Δ |
| Comparative Example 4 | 0.3 | — | 80 nm | Not observed | ○ | x |
| Comparative Example 5 | 17.2 | — | 239 nm | Not observed | x | Δ |
| Comparative Example 6 | 9.3 | — | — | Not observed | x | Δ |

The present disclosure can provide a toner which has achieved both high flowability and paper separability.

The present disclosure also relates to a method for manufacturing the above-described excellent toner.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-148016 filed Jul. 28, 2016, which is hereby incorporated by reference herein in its entirety.

What is claimed is:

1. A toner comprising:

toner particles each of which contains a binding resin having an ester bond, a colorant, and polysiloxane, wherein the polysiloxane is dimethylpolysiloxane, the toner particles contain the polysiloxane in a content of 1 mass % or more and 15 mass % or less based on a total mass of the toner particles, each of the toner particles has a domain in which the polysiloxane is contained, wherein in a cross section of each of the toner particles, the domain has a major axis of 10 nm or more and 500 nm or less, wherein when in an FT-IR spectrum of the toner particles measured and obtained by an ATR method under conditions where Ge is used as an ATR crystal and an infrared light incidence angle is 45°, a maximum absorption peak intensity in a range of 990 $cm^{-1}$ or more and 1040 $cm^{-1}$ or less derived from Si—O of the polysiloxane is defined as Pa (Ge), a maximum absorption peak intensity in a range of 1500 $cm^{-1}$ or more and 1800 $cm^{+1}$ or less derived from C(═O) of an ester group of the binding resin is defined as Pb (Ge), and a value of Pa (Ge)/Pb (Ge) is defined as a siloxane index (Ge); and in an FT-IR spectrum of the toner particles measured and obtained by an ATR method under condition where diamond is used as an ATR crystal and an infrared light incidence angle is 45°, a maximum absorption peak intensity in a range of 990 $cm^{-1}$ or more and 1040 $cm^{-1}$ or less derived from the Si—O of the siloxane is defined as Pa (D), a maximum absorption peak intensity in a range of 1500 $cm^{+1}$ or more and 1800 $cm^{-1}$ or less derived from the C(═O) of the ester group of the binding resin is defined as Pb (D), and a value of Pa(D)/Pb(D is defined as a siloxane index (D), a ratio of the siloxane index (Ge) to the siloxane index (D), i.e. Siloxane index (Ge)/Siloxane index (D), is 1.0 or less.

2. The tone according to claim 1, wherein each of the toner particles further contain wax, and the wax is aliphatic hydrocarbon.

3. The tone according to claim 1, wherein the binding resin is amorphous polyester.

4. The toner according to claim 1, wherein each of the toner particles further contain a crystalline polyester.

5. The toner according to claim 1, wherein when the content of the polysiloxane in the toner particles is defined as X, and the ratio of the siloxane Lox (Ge) to the siloxane index (D) is defined as Y, product (X×Y) is 1.0 or more and 5.0 or less.

6. The toner according to claim 1, wherein an average circularity of the toner particles is 0.90 or more and 0.97 or less.

7. The toner according to claim 1, wherein the toner particles have fine concavities and convexities of 100 nm or more and 500 nm or less on a surface of the toner particles.

8. A method for manufacturing a toner comprising:

emulsifying polysiloxane in an aqueous medium to obtain a emulsion liquid of emulsified particles of the polysiloxane;

dispersing a binding resin in an aqueous medium to obtain a dispersion liquid of resin fine particles;

mixing the emulsion liquid of the emulsified particles of the polysiloxane and the dispersion liquid of the resin fine particles; and aggregating the emulsified particles of the polysiloxane and the resin fine particles to obtain toner particles, wherein the toner particles contain a resin having an ester bond, a colorant, and polysiloxane, the polysiloxane is dimethylpolysiloxane, a content of the polysiloxane in the toner particles is 1 mass % or more and 15 mass % or less based on a total mass of the toner particles, a ratio (Siloxane index (Ge)/Siloxane index (D)) of a siloxane index (Ge) to a siloxane index (D) in the toner particles is 1.0 or less, the toner particles have a domain of the polysiloxane, a major axis of the domain of the polysiloxane in a cross section of the toner particles is 10 nm or more and 500 nm or less, and the siloxane index (GE) is a value of Pa (Ge)/Pb (Ge) when a maximum absorption peak intensity in range of 990 $cm^{-1}$ or more and 1040 $cm^{1}$ or less derived from Si—O of the polysiloxane is defined as Pa (Ge) and a maximum absorption peak intensity in range of 1500 $cm^{-1}$ or more and 1800 $cm^{-1}$ or less derived from C(═O) of an ester group of a binding resin is defined as Pb (Ge) in an FT-IR spectrum measured and obtained by an ATR method under conditions where Ge is used as an ATR crystal and an infrared light incidence angle is 45° and the siloxane index (D) is Pa (D)/Pb(D) when a diamond is used as the ATR crystal, a maximum absorption peak intensity in a range of 990 $cm^{-1}$ or more and 1040 $cm^{-1}$ or less derived from the Si—O of the siloxane is defined as Pa (D), and a maximum absorption peak intensity in a range of 1500 $cm^{-1}$ or more and 1800 $cm^{-1}$ or less derived from the C(═O) of the ester group of the binding resin is defined as Pb (D).

9. The method for manufacturing a toner according to claim 8, wherein a median size on a volume basis of the emulsified particles of the polysiloxane is 0.05 μm or more 10.5 μm or less.

* * * * *